United States Patent [19]

Edwards et al.

[11] 4,076,633

[45] Feb. 28, 1978

[54] FABRIC TREATING ARTICLES WITH IMPROVED CONDITIONING PROPERTIES

[75] Inventors: James B. Edwards, Cincinnati; Francis L. Diehl, Wyoming, both of Ohio

[73] Assignee: The Procter & Gamble Company, Cincinnati, Ohio

[21] Appl. No.: 516,051

[22] Filed: Oct. 18, 1974

[51] Int. Cl.[2] ..... D06M 13/46; D06M 15/04; D06M 15/22; D06M 15/24

[52] U.S. Cl. ..... 252/8.75; 252/8.6; 252/8.8; 252/8.9; 427/212; 427/242; 428/219

[58] Field of Search ..... 252/8.6, 8.75, 8.8, 252/8.9; 117/139.5; 427/212, 242; 428/219

[56] References Cited

U.S. PATENT DOCUMENTS

| | | | |
|---|---|---|---|
| 2,961,339 | 11/1960 | Wolff | 427/212 |
| 3,676,199 | 7/1972 | Hewitt et al. | 427/242 |
| 3,686,025 | 8/1972 | Morton | 428/219 |
| 3,861,870 | 1/1975 | Edwards et al. | 252/8.6 X |
| 3,896,033 | 7/1975 | Grimm | 252/8.9 X |

*Primary Examiner*—Thomas De Benedictis, Sr.
*Attorney, Agent, or Firm*—Jerry J. Yetter; Julius P. Filcik; Richard C. Witte

[57] ABSTRACT

Softening articles with improved fabric conditioning properties comprising fabric softener, certain substantially water-insoluble particulate materials and a dispensing means especially adapted for use in an automatic clothes dryer are described. The articles simultaneously provide softness, ease of ironing, anti-wrinkling and improved appearance and aesthetic benefits to fabrics treated therewith.

13 Claims, No Drawings

FABRIC TREATING ARTICLES WITH IMPROVED CONDITIONING PROPERTIES

BACKGROUND OF THE INVENTION

This invention relates to fabric treating articles which comprise a substantially water-insoluble particulate material releasably combined with a dispensing means. The articles also preferably contain one or more fabric softeners. These articles are especially adapted for use in an automatic clothes dryer to impart anti-wrinkling, ease of ironing, softness, folding ease, enhanced drapability, and appearance benefits to fabrics concurrently with a fabric drying operation.

Treating fabrics in an automatic clothes dryer has recently been shown to be an effective means for conditioning and imparting desirable tactile properties thereto. In particular, it is becoming common to soften fabrics in an automatic clothes dryer rather than during the rinse cycle of a laundering operation. Treating fabrics in the dryer, rather than in the wash, enables the formulator of fabric conditioners to develop and use materials which may not be compatible with detergents. Moreover, the user of dryer-added conditioners is not compelled to make the special effort to add the product during the rinse cycle in the manner required with many rinse-added products.

While significant advances in the art of softening fabrics in the dryer have been made, it has now been discovered that softness is but one of several important benefits which can be imparted to fabrics in this manner. As noted hereinabove, the present invention provides a means whereby many desirable properties can be imparted to fabrics concurrently with a standard drying operation in any automatic dryer.

It is an object of the present invention to condition fabrics in an automatic clothes dryer.

It is another object herein to provide articles which can be added to a clothes dryer to condition fabrics concurrently with a drying operation.

These and other objects are obtained herein as will be seen from the following disclosure.

DESCRIPTION OF THE PRIOR ART

U.S. Pat. No. 3,822,145, Liebowitz, et al., FABRIC SOFTENING, issued July 2, 1974, relates to the use of spherical materials as fabric softening agents. U.S. Pat. Nos. 3,743,534, Zamora, et al., PROCESS FOR SOFTENING FABRICS IN A DRYER, issued July 3, 1973; 3,698,095, Grand, et al., FIBER CONDITIONING ARTICLE, issued Oct. 17, 1972; 3,686,025, Morton, TEXTILE SOFTENING AGENTS IMPREGNATED INTO ABSORBENT MATERIALS, issued Aug. 22, 1972; 3,676,199, Hewitt, et al., FABRIC CONDITIONING ARTICLE AND USE THEREOF, issued July 11, 1972; 3,633,538, Hoeflin, SPHERICAL DEVICE FOR CONDITIONING FABRICS IN DRYER, issued Jan. 11, 1972; 3,634,947, Furgal, COATING APPARATUS, issued Jan. 18, 1972; 3,632,396, Zamora, DRYER-ADDER FABRIC-SOFTENING COMPOSITIONS, issued Jan. 4, 1972; and 3,442,692, Gaiser, METHOD OF CONDITIONING FABRICS, issued May 6, 1969, each relate to articles and methods for conditioning fabrics in automatic dryers. U.S. Pat Nos. 3,033,699, Aarons, et al., ANTISTATIC COMPOSITION, issued May 8, 1962; 3,063,128, Etchison, PROCESS FOR CONTROLLING STATIC PROPERTIES OF SYNTHETIC TEXTILE FIBERS, issued Nov. 13, 1962; 3,766,062, Wixon, 1,2-ALKANEDIOL CONTAINING FABRIC SOFTENING COMPOSITIONS, issued Oct. 16, 1973; 3,785,973, Bernholz, et al., TEXTILE FINISH, issued Jan. 15, 1974; and 3,793,196, Okazaki, et al., SOFTENING AGENT, issued Feb. 19, 1974, relate to fabric softening agents of various types. U.S. Pat. No. 3,594,212, Ditsch, TREATMENT OF FIBROUS MATERIALS WITH MONTMORILLONITE CLAYS AND POLYAMINES AND POLYQUATERNARY AMMONIUM COMPOUNDS relates to the treatment of fibrous materials with clays and amine or ammonium compounds. Fatty alcohols are well-known "scrooping" agents for use on textiles.

The co-pending application of Edwards and Diehl, entitled FABRIC SOFTENING COMPOSITIONS WITH IMPROVED CONDITIONING PROPERTIES, Ser. No. 357,130, filed May 4, 1973, discloses mixtures of fabric softeners and particulate conditioners. The co-pending applications of Murphy, et al., Ser. Nos. 417,329, filed Nov. 19, 1973; 440,931, filed Feb. 8, 1974; 440,932, filed Feb. 8, 1974; and Murphy, et al., Ser. No. 461,311, filed Apr. 16, 1974; and Zaki, Ser. No. 461,312, filed Apr. 16, 1974, each relate to dryer-added fabric softeners and articles of various types.

The concurrently-filed application of Ned C. Webb, et al. entitled FABRIC TREATING COMPOSITIONS AND ARTICLES, Ser. No. 516,052, filed 10/18/1974, relates to dryer-added particulate conditioners which provide a desirable substantive odor to fabrics.

SUMMARY OF THE INVENTION

The instant invention is based on the discovery that certain water-insoluble particulate materials can be applied to clothing and fabrics in an automatic clothes dryer to provide anti-wrinkling and ease of ironing benefits thereto. The particulate materials also make the fabrics easier to fold and enhance their drapability, thereby resulting in an improved appearance.

The particulate materials employed in the practice of this invention are used in combination with a dispensing means to provide an article containing a premeasured amount of said particulate material. The dispensing means is designed to dispense the particulate material evenly and efficiently onto fabric surfaces with the tumbling action of an automatic clothes dryer.

Preferred articles herein comprise the particulate material, the dispensing means, and one or more fabric softening compounds. Such articles can be formulated to distribute both the fabric softener and the particulate material onto fabric surfaces evenly and efficiently during a drying operation in an automatic clothes dryer.

In its process aspect, this invention encompasses a process for conditioning fabrics comprising combining damp fabrics with an article of the type hereinabove disclosed in an automatic clothes dryer and operating said automatic dryer, with tumbling, in standard fashion.

DETAILED DESCRIPTION OF THE INVENTION

The articles herein comprise multiple components, each of which are discussed, in turn, below.

PARTICULATE COMPONENT

The substantially water-insoluble particulate material used in the articles of the instant invention is characterized by: (1) an average particle size from about 1.0 micrometers (μm) to about 50 μm, preferably from about 5 μm to about 30 μm; (2) a shape having an anisotropy of from about 5:1 to about 1:1; (3) a hardness of less than about 5.5 on the Mohs scale; (4) a melting (softening) temperature above about 150° C; and (5) substantial freedom from exchangeable calcium and magnesium ions.

The average particle size limitation of the substantially water-insoluble particulate material herein relates to the diameters of commercially available textile fibers, which, for the most part, fall within the range of about 10 μm to about 30 μm. For the reasons described more fully hereinafter, particulate materials having an average diameter greater than about 50 micrometers do not provide the fabric benefits enumerated hereinbefore. Likewise, particulate materials whose particle size diameter is less than about 1 μm do not provide the desired fabric conditioning benefits.

The particulate material herein is further characterized by an anisotropy (axial ratio) of about 5:1 to 1:1. The determination of particle size can be based on the measurement of the projection area of the water-insoluble particle, or on the linear measures of this projection area. That is to say, for the loose particle, resting on its surface of maximum stability, the long and intermediate axes are normally horizontal and the short axis is vertical. In that context, the term "long axis" represents the maximum overall length of the particle; "intermediate axis" stands for the maximum dimension of a particle in a direction perpendicular to the long axis; and "short axis" represents the maximum dimension in a direction perpendicular to the plane containing the long and intermediate axes. The term "anisotropy" means the ratio of long axis to short axis for a specific particulate material. (See ADVANCES IN OPTICAL AND ELECTRON MICROSCOPY, Vol. 3, R. Barer and V. E. Cosslett, ACADEMIC PRESS 1969, London and New York.) Preferred for use in the compositions of this invention are particulate materials having an anisotropy within the range from about 3:1 to about 1.1:1.

The particulate material used herein is further characterized by a hardness of less than about 5.5 on the Mohs scale. The hardness is a measure of resistance to crushing, and is a good indication of the abrasive character of a solid material. Examples of materials arranged in increased order of hardness according to the Mohs scale are as follows: h(hardness)-1: talc, dried filter-press cakes, soap-stone, waxes, aggregated salt crystals; h-2: gypsum, rock salt, crystalline salt in general; h-3: barytes, chalk, brimstone, calcite; h-4: fluorite, soft phosphate, magnesite, limestone; h-5: apatite, hard phosphate, hard limestone, chromite, bauxite; h-6: feldspar, ilmenite, hornblendes; h-7: quartz, granite; h-8: topaz; h-9: corundum, emery; and h-10: diamond.

Suitable particulate materials have a hardness of less than about 5.5 on the Mohs scale. Although some conditioning benefits can be obtained with particulate materials having a Mohs hardness of up to about 7, overall benefits secured with such materials are not optimal, and such materials are not used in the instant articles. One reason for avoiding such high hardness materials is that they can cause fiber and yarn damage which adversely affect the fabric, especially after multi-cycle treatments.

The particulate materials used herein have a melting (softening) point above about 150° C. Particulate materials having a melting point below that temperature do not provide the fabric benefits because of their tendency to melt, or soften, and spread throughout the fabric. This is undesirable in the context of this invention and the particulate materials must maintain their shape and integrity under ironing conditions, i.e., at temperatures of ca. 150° C.

The particulate material must be substantially water-insoluble, inasmuch as its function depends on its integrity, shape, firmness, etc., as described in detail hereinabove. It should be recognized, however, that minor portions of the particulate ingredient, preferably not more than 20% by weight, can be water-soluble without markedly decreasing performance.

The water-insoluble particulate material is substantially free of exchangeable calcium and magnesium ions. The presence of exchangeable alkaline earth metal ions such as calcium and magnesium in the particulate materials appears to increase their hydrophilic properties. This results in enhanced swelling and constitutes an obstacle to the uniform and stable enmeshing of the particulate material within the fiber structure.

While not intending to be bound by theory, it appears that the particulate material herein interacts with fabrics at the fiber level to impart the described benefits to the textile fabric as a whole. In this regard, it is known that yarns and fabrics consist of assemblies of fine flexible fibers arranged in more-or-less orderly arrays. Individual fibers within such assemblies are usually in a bent or twisted configuration and are in various states of contact with neighboring fibers. When the assembly is deformed, the fibers move relative to each other and this relative motion accounts for much of the characteristic flexibility of textile materials. To what extent a given textile material will recover when a deforming force is removed determines how much "wrinkling" occurs. Recovery is largely determined by the nature of the interaction of the individual fibers making up the textile material. Textile fibers are viscoelastic and exhibit delayed recovery from strain. Moreover, the large number of interfiber contact points provide significant frictional restraints which further hinder the recovery process. By overcoming such frictional restraints the recovery process is hastened.

This view of the microscopic nature of fibers and textiles and the physical forces involved in deformation and recovery processes helps explain the efficacy of the particulate materials herein in imparting anti-wrinkling, ease of ironing, etc. benefits thereto. For purpose of conceptualization, the mode of action of the particulate materials herein is conveniently referred to as a "ball bearing" effect. This conceptualization is useful in interpreting the interaction of the particulate material and the textile matrix under deformation.

By means of microscopic analysis and staining techniques, it has been determined that textile fabrics treated with discrete particulate materials have such materials intimately and substantively dispersed in the inerstices of the fiber matrix. It is belived that once interfiberly positioned, the particles act in the manner of ball bearings to reduce interfiber forces during deformation of the textile fabric as a whole. The overall effect is the enhancement of viscoelastic recovery (anti-wrinkling effect) and diminution of the forces operable at interfiber contact points (ease of ironing effect). The diameter limitation of the particulate materials used herein is appreciated since most commercially available textile fibers have diameters which fall within the range of about 10 μm to about 30 μm, and the particulate material of the invention must be comparable in diameter to the fibers.

Moreover, the appearance benefits imparted to textiles treated in the present manner are similarly related to the presence of the particulate material at points within interstices of individual fiber yarns. Microscopic examination of textile yarns in cross section reveals that textiles treated with the instant particulate materials exhibit greater yarn diameters than untreated yarns. Apparently, the particulate materials positioned in the interfiber spaces effectively open up the yarn (apparent increase in bulk) resulting in a softer, fluffier fabric. The anti-static benefit imparted by the particles is related to a decrease in resistivity of the treated fabric matrix, perhaps occasioned by an increase in the equilibrium moisture content of the fabric.

Non-limiting examples of useful particulate materials herein include surface-modified, water-insoluble starch granules; beads of synthetic polymers such as poly(methylmethacrylate) m.p. 160° C–200° C; poly(tetrafluoroethylene) m.p. 327° C–330° C; polystyrene m.p. 240° C–250° C; poly(styrenedivinylbenzene) m.p. >150° C; poly(melamine urea formaldehyde) m.p. >150° C; and poly(urea formaldehyde) m.p. >150° C; glass, coated glass, and hollow glass beads; and various ceramic beads. Thus, both inorganic and organic particulate characterized by the above-described parameters are all useful herein.

Specific examples of particulate materials useful herein include the following.

a. Surface-treated starches (preferred herein) such as "DRY-FLO" starch manufactured by NATIONAL STARCH PRODUCTS, New York. DRY-FLO starches are surface-modified starches bearing hydrophobic moieties which have been reacted with the starch molecule through the formation of ester and ether linkages. As a result of this chemical modification, these derivatized starches are water-repellent and substantially water-insoluble. DRY-FLO starches have an average particle size diameter of about 9–11 micrometers.

b. Glass microballoons, avg. size range 5–15 μm, manufactured by EMERSON & CUMING, Canton, Mass.

c. Glass beads, avg. size range 5–44 μm, manufactured by CATAPHOTE CORP., Jackson, Miss., and marketed as PF 12-R, PF-11, PF-12 and PF-12S.

Another substantially water-insoluble particulate material useful herein is a starch granule having, in addition to the above-described characteristics, a swelling power of less than about 15 at a temperature of 65° C. Modified starches, i.e., the more water-soluble starches obtained by various common gelatinizing, derivatizing, or degrading techniques do not have a firm shape and are not used in the present invention. Such soluble or "gelatinizable" starch granules having a swelling power of more than about 15° at 65° C tend to lose their shape and run into the inter-fiber spaces, with the result that fabrics treated therewith become undesirably stiff.

The selection of starches based on their swelling power can be done using the standard method set forth in Cereal Chem., 36, pp. 534–544 (1959) Harry W. Leach, et al., incorporated herein by reference. Although the final choice of starch which will meet the requirements of this invention depends on its origin and the processing to which it has been subjected, suitable starches are obtained from corn, wheat and rice. Most potato and tapioca starches have a swelling power exceeding 15 at a temperature of 65° C and are not suitable for use herein. More complete information concerning water-insoluble, low-swelling starches, processes for their preparation and their isolation from a variety of raw materials appears in *THE STARCH INDUSTRY*, Knight, J. W., Pergamon Press, London (1969), incorporated herein by reference.

DISPENSING MEANS

The particulate materials and softeners of the foregoing type can be employed by simply placing a measured amount in the dryer, e.g., as an aqueous dispersion. However, in a preferred embodiment the particulate materials (preferably with the softener) are provided as an article of manufacture in combination with a dispensing means which effectively releases them in an automatic clothes dryer. Such dispensing means can be designed for single usage or for multiple uses.

One such article comprises a pouch releasably enclosing enough of the particulate material (with or without softener) to condition fabrics during several cycles of clothes. This multi-use article can be made by filling a hollow, open pore polyurethane sponge pouch with about 10 grams of the particulate material. In use, the tumbling action of the dryer causes the particles to pass through the pores of the sponge and onto the fabrics. Such a filled sponge can be used to treat several loads of fabrics in conventional dryers, and has the advantage that is can remain in the dryer after use and is not likely to be misplaced or lost.

Another article comprises a cloth or paper bag releasably enclosing the particulate material and sealed with a wax which softens at dryer operating temperatures. The action of the dryer opens the bag and releases the particles to perform their conditioning function.

A highly preferred article herein comprises the particulate material releasably affixed to a sheet of paper or woven or non-woven cloth substrate such that the action of the automatic dryer removes the material and deposits it on the fabrics. (As more fully described hereinafter, the particulate material can be releasably affixed to the sheet substrates in various ways, but is preferably and conveniently affixed by means of a melt of a fabric softener component.)

The sheet conformation has several advantages. For example, effective amounts of the particulate material (and softener) for use in conventional dryers can be easily sorbed onto and into the sheet substrate by simple dipping or padding processes. Thus, the user need not measure the amount of material necessary to condition fabrics. Additionally, the flat configuration of the sheet provides a large surface area which results in efficient release of the materials onto fabrics by the tumbling action of the dryer.

The water-insoluble paper, or woven or non-woven substrates used in the articles herein can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

Highly preferred paper, woven or non-woven "absorbent" substrates useful herein are fully disclosed in U.S. Pat. No. 3,686,025, Morton, TEXTILE SOFTENING AGENTS IMPREGNATED INTO ABSORBENT MATERIALS, issued Aug. 22, 1972, incorporated herein by reference. These substrates are particularly useful with articles comprising both the particulate material and a fabric softener. It is known that most substances are able to absorb a liquid substance to some degree; however, the term "absorbent," as used herein, is intended to mean a substance with an absorbent capacity (i.e., a parameter representing a substrate's ability to take up and retain a liquid) from 5.5 to 12, preferably 7 to 10, times its weight of water.

Determination of absorbent capacity values is made by using the capacity testing procedures described in U.S. Federal Specifications UU-T-595b, modified as follows:

1. tap water is used instead of distilled water;
2. the specimen is immersed for 30 seconds instead of 3 minutes;
3. the draining time is 15 seconds instead of 1 minute; and
4. the specimen is immediately weighed on a torsion balance having a pan with turned-up edges.

Absorbent capacity values are then calculated in accordance with the formula given in said Specification. Based on this test, one-ply, dense bleached paper (e.g., kraft or bond having a basis weight of about 32 pounds per 3,000 square feet) has an absorbent capacity of 3.5 to 4; commercially available household one-ply toweling paper has a value of 5 to 6; and commercially available two-ply household toweling paper has a value of 7 to about 9.5.

Using a substrate with an absorbent capacity of less than 5.5 tends to cause too rapid release of the softener from the substrate resulting in several disadvantages, one of which is uneven softening of the fabrics. Using a substrate with an absorbent capacity over 12 is undesirable, inasmuch as too little of the softening agent is released to soften the fabrics in optimal fashion during a normal drying cycle.

The preferred substrates used in this invention can also be defined in terms of "free space." Free space, also called "void volume," as used herein is intended to mean that space within a structure that is unoccupied. For example, certain multi-ply paper structures comprise plies embossed with protuberances, the ends of which are mated and joined; this paper structure has a void volume or free space between the fibers of the paper sheet, itself. A non-woven cloth also has free space between each of its fibers. The free space of non-woven cloth or paper, having designated physical dimensions, can be varied by modifying the density of the fibers of the paper or non-woven cloth. Substrates with a high amount of free space generally have low fiber density; high density substrates generally have a low amount of free space. The preferred substrates of the invention herein have from about 40% to about 90%, preferably about 55%, free space based on the overall volume of the substrate's structure. This free space is directly related to the substrate's having an absorbency value of 5.5 to 12.

The use of dense, one-ply or ordinary kraft or bond paper for the softening agent substrate can result in increased staining of certain types of treated fabrics. This staining is caused by too rapid or uneven release of the fatty (greasy) softener due to the low absorbent capacity of the paper substrate.

Softening agents on dense paper can be rapidly and unevenly released in excessive quantities when subjected to customary dryer temperatures, with the result that treated fabrics can become stained at points of contact with the softener-coated paper. Fabric staining can be eliminated altogether by employing a substrate having an absorbent capacity in the range of 5.5 to 12, such that less of the softening agent is released at any given point of time when contacted with the fabric being treated.

As noted above, suitable materials which can be used as a substrate in the invention herein include, among others, sponges, paper, and woven and non-woven cloth, all having the absorbency parameters defined above. The preferred substrates of the softening compositions herein are cellulosic, particularly multi-ply paper and non-woven cloth.

More specifically, a preferred paper substrate comprises a compressible, laminated, calendered, multi-ply, absorbent paper structure. Preferably, the paper structure has 2 or 3 plies and a total basis weight of from 14 to 90 pounds per 3,000 square feet and absorbent capacity values within the range of 7 to 10. Each ply of the preferred paper structure has a basis weight of about 7 to 30 pounds per 3,000 square feet, and the paper structure can consist of plies having the same or different basis weights. Each ply is preferably made from a creped, or otherwise extensible, paper with a creped percentage of about 15% to 40% and a machine direction (MD) tensile and cross-machine (CD) tensile of from about 100 to 1,500 grams per square inch of paper width. The two outer plies of a 3-ply paper structure or each ply of a 2-ply paper structure are embossed with identical repeating patterns consisting of about 16 to 200 discrete protuberances per square inch, raised to a height of from about 0.010 inch to 0.40 inch above the surface of the unemboseed paper sheet. From about 10% to 60% of the paper sheet surface is raised. The distal ends (i.e., the ends away from the unembossed paper sheet surface) of the protuberances on each ply are mated and adhesively joined together, thereby providing a preferred paper structure exhibiting a compressive modulus of from about 200 to 800 inch-grams per cubic inch and Handle-O-Meter (HOM) MD and CD values of from about 10 to 130.

Suitable adhesives for multi-ply paper are known in the art and include water, starches, wet-strength resins, and polyvinyl acetates. A particularly suitable adhesive is prepared by heating from about 2 to about 4 parts by weight of substantially completely hydrolyzed polyvinyl alcohol resin in from about 96 to about 98 parts by weight of water. Preferably, about 0.03 pound of adhesive solids are used to join 3,000 square feet of the embossed plies, with the adhesive being applied to the distal surfaces of the protuberances of one or all plies.

The compressive modulus values which define the compressive deformation characteristics of a paper structure compressively loaded on its opposing surfaces, the HOM values which refer to the stiffness or handle of a paper structure, the MD and CD HOM values which refer to HOM values obtained from paper structure samples tested in a machine and cross-machine direction, the methods of determining these values, the equipment used, and a more detailed disclosure of the paper structure preferred herein, as well as methods of its preparation, can be found in U.S. Pat. No. 3,414,459, Wells, COMPRESSIBLE LAMINATED PAPER STRUCTURE, issued Dec. 3, 1968, the disclosures of which are incorporated herein by reference.

The preferred non-woven cloth substrates used in the invention herein can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e., an array of fibers in a carded web wherein partial orientation of the fibers is frequently present, as well as a completely haphazard distributional orientation), or substantially aligned. The fibers or filaments can be natural (e.g., wool, silk, jute, hemp, cotton, linen, sisal, or ramie) or synthetic (e.g., rayon, cellulose ester, polyvinyl derivatives, poly-olefins, polyamides, or polyesters).

Methods of making non-woven cloths are not a part of this invention and, being well known in the art, are not described in detail herein. Generally, such cloths are made by air- or water-laying processes in which the fibers or filaments are first cut to desired lengths from long strands, passed into a water or air stream, and then deposited onto a screen through which the fiber-laden air or water is passed. The deposited fibers or filaments are then adhesively bonded together, dried, cured, and otherwise treated as desired to form the non-woven cloth. Non-woven cloths made of polyesters, polyamides, vinyl resins, and other thermoplastic fibers can be span-bonded, i.e., the fibers are spun out onto a flat surface and bonded (melted) together by heat or by chemical reactions.

The absorbent properties required in the preferred particulate-plus-softener herein are quite easy to obtain with non-woven cloths and are provided merely by building up the thickness of the cloth, i.e., by superimposing a plurality of carded webs or mats to a thickness adequate to obtain the necessary absorbent properties, or by allowing a sufficient thickness of the fibers to deposit on the screen. Any diameter or denier of the fiber (generally up to about 10 denier) can be used, inasmuch as it is the free space between each fiber that makes the thickness of the cloth directly related to the absorbent capacity of the cloth, and which, further, makes the non-woven cloth especially suitable for impregnation with a softening agent by means of intersectional or capillary action. Thus, any thickness necessary to obtain the required absorbent capacity can be used.

The choice of binder-resins used in the manufacture of non-woven cloths can provide substrates possessing a variety of desirable traits. For example, the absorbent capacity of the cloth can be increased, decreased, or regulated by respectively using a hydrophilic binder-resin, a hydrophobic binder-resin, or a mixture thereof, in the fiber bonding step. Moreover, the hydrophobic binder-resin, when used singly or as the predominant compound of a hydrophobic-hydrophilic mixture, provides non-woven cloths which are especially useful as substrates when the articles herein are used with damp fabrics in an automatic dryer.

When the substrate for the articles herein is a non-woven cloth made from fibers deposited haphazardly or in random array on the screen, the articles exhibit excellent strength in all directions and are not prone to tear or separate when used in the automatic clothes dryer.

Preferably, the non-woven cloth is water-laid or air-laid and is made from cellulosic fibers, particularly from regenerated cellulose or rayon, which are lubricated with any standard textile lubricant. Preferably, the fibers are from 3/16 inch to 2 inches in length and are from 1.5 to 5 denier. Preferably, the fibers are at least partially oriented haphazardly, particularly substantially haphazardly, and are adhesively bonded together with a hydrophobic or substantially hydrophobic binder-resin, particularly with a nonionic self-crosslinking acrylic polymer or polymers. Preferably, the cloth comprises about 70% fiber and 30% binder-resin polymer by weight and has a basis weight of from about 20 to 24 grams per square yard.

The fabric conditioning articles of the present invention are structured to be compatible with conventional laundry dryer designs. While it is preferred to employ the articles of the present invention in an automatic laundry dryer, other equivalent machines can be employed, and in some instances, heat and drying air may be omitted for part or all of the cycle. Generally, however, heated air will be employed and such air will be circulated frequently in the dryer. Normally, there are from about 5 to 50 volume changes of drying air in the dryer drum per minute and the air moves at about 125 to 175 cubic feet per minute. These changing volumes of air create a drawing or suction effect which can, especially with small fabric loads, cause an item such as a sock, handkerchief or the like, or a fabric conditioning article, to be disposed on the surface of the air outlet of the dryer. A usual load of fabrics of from about 4 to 12 pounds dry weight will fill from about 10% to 70% of the volume of most dryers and will normally pose little difficulty. A sufficient numer of tumbling items will normally be present to prevent any item from being drawn to the exhaust outlet or to cause it to be removed from the outlet. In the event, however, a fabric conditioning article is caused to be disposed in relation to the air exhaust outlet in such a manner as to cause blockage of passing air, undesirable temperature increases can result. In the case of fabric conditioning articles employing the normally solid or waxy softeners (e.g., sorbitan esters) which soften or melt under conditions of heat, the article may tend to adhere to an exhaust outlet.

The problem of blockage can be solved by providing openings in the article in the manner described in the U.S. patent applications of A. R. McQueary, Ser. No. 347,605. filed Apr. 3, 1973, and Ser. No. 347,606, filed Apr. 3, 1973, both incorporated herein by reference. More specifically, slits or holes are cut through the substrate to allow free passage of air.

The slit openings are provided in the fabric conditioning articles of the invention for two principal purposes. Importantly, the slits permit passage of air in the event the article is placed in a blocking relationship to the air exhaust outlet. Moreover, the slit openings provide a degree of flexibility or resiliency which causes the article to crumple or pucker. The effect of such crumpling is that only a portion of the air exhaust outlet will be covered by the conditioning article in the event it is carried by the moving air stream to the exhaust outlet. Moreover, the crumpled article is more readily removed by tumbling fabrics than would be the case if the article were placed in a flat relationship to the exhaust outlet.

The type and number of slit openings can vary considerably and will depend upon the nature of the substrate material, its inherent flexibility or rigidity, the nature of the conditioning agent carried therein or thereon, and the extent to which increased passage of air therethrough is desired. The articles of this invention can comprise a large number of small slits of various types or configurations, or fewer larger slits. For example, a single rectilinear or wavy slit, or a plurality thereof, confined to within the area of a sheet and extending close to opposite edges of the article, can be employed. By maintaining a border around all edges of the conditioning article, a desired degree of flexibility and surface area availability to tumbling fabrics can maintained. While, for example, rectilinear slits can be cut into a conditioning article completely to the edges of the article, confinement of the slits to within the area of the article will be preferred where the convenience of packaging the conditioning article in roll form is desired.

According to one preferred embodiment of the invention, a sheet of fabric-conditioning article is provided with a plurality of rectilinear slits extending in one direction, e.g., the machine direction of the web substrate, and in a substantially parallel relationship. The slits can be aligned or in a staggered relationship. A preferred embodiment will contain from 5 to 9 of such slits which will to within about 2 inches and preferably 1 inch from the edge of the web material which is, for example, a 9 inch × 11 inch sheet. In general, the greater the number and the longer the slits, the greater the effect in preventing restriction of air flow. Such an article permits the individual panel areas or sections within the rectilinear slits to flex or more in independent relationship to each other and out of the plane of the sheet. This flexing minimizes the probability that such an article will align itself in a flat and blocking relationship to an exhaust outlet. The inherent puckering or crumpling tendency of the article allows the article to contact the air outlet in such a manner as to leave at least a portion of the air exhaust outlet uncovered. In addition, the tumbling fabrics in the dryer will collide with the crumpled article causing it to be removed from the exhaust outlet. Removal is readily accomplished by reason of the protrusion of the crumpled article which makes it more available for contact with the tumbling load of fabrics in the dryer.

The slit openings in the conditioning articles of the invention can in a variety of configurations and sizes, as can be readily appreciated. In some instances, it may be desirable to provide slit openings as C-, U-, or V-shaped slits. Such slits arranged in a continuous or regular or irregular pattern are desirable from the standpoint of permitting gate-like or flap structures which permit the passage of air therethrough.

In accordance with a preferred embodiment of the invention, a plurality of curvilinear slit openings, such as U-shaped, or C-shaped slits, are provided in a continuously patterned arrangement. These slit arrangements provide flap-like or gate-like structures which should approximate the size of the perforations normally employed in laundry dryer exhaust outlets. A width dimension of from about 0.02 to about 0.40 inch is preferred. U- or C-shaped slits, e.g., about ⅛ inch in diameter, are desirably provided is close proximity to each other, e.g., about ⅛ inch apart, as to simulate, for example, a fish-scale pattern. Such design, in addition to permitting passage of air, provides a degree of flexibility to the substrate and allows flexing or puckering of the article in use. Similarly, the slit openings can be arranged as spaced rows of slits or as a plurality of geometrical patterns. For example, a sheeted article of this invention can comprise a plurality of squares, circles, triangles or the like, each of which is comprised of a plurality of individual slits. Other embodiments including small or large S-shaped slits, X-slits or crosses, slits conforming to alphabetical or numerical patterns, logograms, marks, floral and other designs can also be employed.

As an alternative to slits, the article can be provided with one or more circular holes having a diameter of from about 0.02 inches to about 4 inches, from about 5% to about 40% of the surface area of the article comprising said holes. The holes can be disposed in any convenient relationship to one another but it is simplest, from a manufacturing standpoint, to punch the holes through the substrate in evenly spaced rows.

FABRIC SOFTENER

The present articles are preferably fashioned in combination with a fabric softener. Such fabric softeners are selected from those which melt (or flow) at dryer operating temperatures and which are transferred from the dispensing means onto clothes coming in contact therewith in the dryer. The fabric softeners used herein are characterized by a melting point above about 38° C. Lower melting softeners flow at room temperature and result in an undesirable tackiness, both in the article and on the fabrics treated therewith. Highly preferred softeners herein melt (or flow) at temperatures of about 45° C to about 70° C, i.e., temperatures within the range found in most home dryers. However, softeners which melt at temperatures up to 100° C, and higher, are useful in some commercial dryers. Moreover, many softeners can be admixed with diluents of the type disclosed hereinafter to adjust their melting points to within a desired range.

It is to be understood that mixtures of fabric softeners can be employed herein concurrently to achieve multiple conditioning benefits. For example, various alcohol-type softeners and quaternary ammonium softeners can be used as admixtures which both soften and provide static control benefits.

The fabric softener employed in the present invention can be any of the cationic (including imidazolinium) compounds listed in U.S. Pat. No. 3,686,025, Morton, TEXTILE SOFTENING AGENTS IMPREGNATED INTO ABSORBENT MATERIALS, issued Aug. 22, 1972, incorporated herein by reference. Such materials are well known in the art and include, for example, the quaternary ammonium salts having at least one, preferably two, $C_{10}$–$C_{20}$ fatty alkyl substituent groups; alkyl imidazolinium salts wherein at least one alkyl group contains a $C_8$–$C_{25}$ carbon "chain"; the $C_{12}$–$C_{20}$ alkyl pyridinium salts, and the like.

Preferred cationic softeners herein include the quaternary ammonium salts of the general formula $R^1R^2R^3R^4N^+,X^-$, wherein groups $R^1$, $R^2$, $R^3$ and $R^4$ are, for example, alkyl and $X^-$ is an anion, e.g., halide, methylsulfate, and the like. Especially preferred softeners herein are those wherein $R^1$ and $R^2$ are each $C_{12}$–$C_{20}$ fatty alkyl and $R^3$ and $R^4$ are each $C_1$–$C_3$ alkyl. The fatty alkyl groups can be mixed, i.e., the mixed $C_{14}$–$C_{18}$ coconutalkyl and mixed $C_{16}$–$C_{18}$ tallowalkyl quanternary compounds. Alkyl groups $R^3$ and $R^4$ are preferably methyl.

Particularly useful quanternary ammonium softeners herein include ditallowalkyldimethylammonium methylsulfate and dicoconutalkyldimethylammonium methylsulfate.

A preferred type of fabric softener employed in the present articles comprises the esterified cyclic dehydration products of sorbitol. Sorbitol, itself prepared of the catalytic hydrogenation of glucose, can be dehydrated in well-known fashion to form mixtures of cyclic 1,4- and 1,5-sorbitol anhydrides and "sorbitan." (See U.S. Pat. No. 2,322,821, Brown, PARTIAL ESTERS OF ETHERS OF POLYHYDROXYLIC COMPOUNDS, issued June 29, 1943.) The resulting complex mixtures of cyclic anhydrides of sorbitol are collectively referred to herein as "sorbitan."

Fabric softeners of the type employed herein are prepared by esterifying the "sorbitan" mixture with a fatty acyl group in standard fashion, e.g., by reaction with a fatty acid halide. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can simply be adjusted to favor the desired reaction product. The sorbitan mono-esters and di-esters are preferred for use in the present invention. While not intending to be limited by theory, it appears that to be optimally useful as a softener, the sorbitan esters should contain unesterified hydroxyl groups to provide hydrogen bonding with, and attachment to, fabric surfaces. The mono- and di-esters of sorbitan fulfill this requirement.

The mixtures of hydroxy-substituted sorbitan esters useful herein contain, inter alia, compounds of the following formulae, as well as the corresponding hydroxy-substituted di-esters:

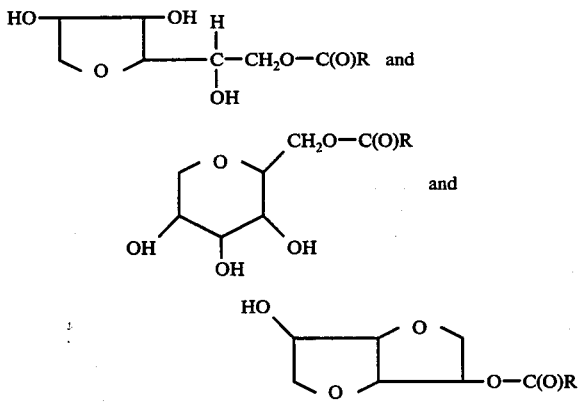

wherein group RC(O)— is a fatty alkyl residue. The foregoing complex mixtures of esterified cyclic dehydration products of sorbitol are collectively referred to herein as "sorbitan esters." Sorbitan mono- and di-esters of lauric, myristic, palmitic, and stearic acids are particularly useful herein for imparting a soft, lubricious feel and anti-static benefit to fabrics. Mixed sorbitan esters, e.g., mixtures of the foregoing estes, and mixtures prepared by esterifying sorbitan with fatty acid mixtures such as the mixed tallow and hydrogenated palm oil fatty acids, are useful herein and are economically attractive. Unsaturated $C_{10}$–$C_{18}$ sorbitan esters, e.g., sorbitan mono-oleate, usually are present in such mixtures. It is to be recognized that all sorbitan esters containing free —OH groups which soften and flow at dryer operating temperatures, i.e., above about 38° C–40° C, but which are solid below this temperature range, and which have fatty hydrocarbyl "tails," are useful softeners in the context of the present invention.

Preparation of the sorbitan esters herein can be achieved by cyclizing sorbitol to form a mixture of cyclic anhydrides of the type set forth above, and separating and esterifying the various cyclic anhydrides using a 1:1 stoichiometry for the esterification reaction. However, separation of the cyclization products is difficult and expensive. Accordingly, it is easier and more economical not to separate the various cyclic anhydrides, but simply to esterify the total mixture. Of course, this results in esterified mixtures of the type disclosed above. Such mixtures of esterified reaction products are commercially available under various tradenames, e.g., Span®.

The preferred alkyl sorbitan esters herein comprise sorbitan monolaurate, sorbitan monomyristate, sorbitan monopalmitate, sorbitan monostearate, sorbitan dilaurate, sorbitan dimyristate, sorbitan dipalmitate, sorbitan distearate, and mixtures thereof, and mixed coconutalkyl sorbitan mono- and di-esters and mixed tallowalkyl sorbian mono- and di-esters. Such mixtures are readily prepared by reacting the foregoing cyclic, hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures containing minor proportions of various tri-esters, uncyclized sorbitol, fatty acids, polymers, isosorbide structures, and the like. The presence or absence of such materials as minor components of the sorbitan mixtures is of no consequence to this invention. For most purposes, the commercially available sorbitan esters which comprise above about 40% by weight, preferably above about 60% by weight, of $C_{10}$–$C_{22}$ mono- and di-esters and which have melting points of at least about 38° C–40° C can be advantageously employed to soften clothes in the manner of this invention. Highly preferred materials include sorbitan monostearate, sorbitan monopalmitate, and 1:10 to 10:1 (wt.) mixtures thereof. Both the 1,4- and 1,5-cyclic sorbitan stearates and palmitates are useful herein, inasmuch as their melting points are above about 38° C–40° C, and they contain at least one hydroxyl group which provides a mode of attachment to fabric surfaces.

Other types of fabric softeners which can be employed herein comprise higher melting fatty alcohols, fatty acids, glycerides, and the like. When employed in an automatic clothes dryer, such materials impart the tactile impression of "crispness" or "newness" to the finally dried fabrics. The term "crispness" as used herein means a distinctive tactile impression best described as "dry" and, in some cases, "crunchy." The fabric crispness properties achieved by these agents provide an added dimension to fabric softness, as it is generally understood. Crisp, soft fabrics can be obtained without the undesirable excess lubricity and greasiness associated with some other fabric softeners.

Useful softeners (or, more broadly, conditions) of this type encompass the substantially water-insoluble compounds selected from the group consisting of alcohols, carboxylic acids, carboxylic acid salts, and mixtures of these compounds. By "substantially water-insoluble" herein is meant a water solubility of 1% by weight, or less, at 30° C. The alcohols are preferred for use herein by virtue of their excellent fabric crisping properties. Moreover, alcohol from the treated fabrics can be slowly transferred to skin on contact with the fabric to provide prolonged emolliency benefits. Mono-ols, di-ols and poly-ols having the requisite melting points and water-insolubility properties set forth above are useful herein. Such alcohol-type materials include the mono- and di-fatty glycerides which contain at least one "free" OH group. The mono-ols are preferred in that they are non-hygroscopic and non-tacky when applied to fabrics.

All manner of water-insoluble, high melting alcohols (including mono- and di-glycerides), carboxylic acids and carboxylate salts are useful herein, inasmuch as all such materials coat fibers and dry to a nontacky fabric finish. Of course, it is desirable to use those materials which are colorless, so as not to alter the color of the fabrics being treated. Toxicologically acceptable materials which are safe for use in contact with skin should be chosen.

Primary, secondary and tertiary alcohols are all useful as the softening/conditioning component of the present articles. The hydrocarbyl moiety of the alcohol can be alkyl, olefinic, acetylenic or multiple unsaturated alkyl, cycloalkyl, heterocyclic, aralkyl, e.g., phenylalkyl, and the like. Aryl alcohols, i.e., the phenolic, provide the fabric crispness benefits herein but are not preferred when treated fabrics are to be in contact with skin for prolonged periods. In short, any alcohol having the requisite water-insolubility and high melting point range is useful herein.

For example, iso-propyl alcohol, a common secondary aliphatic alcohol, is not useful as the fabric crisping component herein due to its low melting point and high water solubility. In contrast, 2-heptadecanol, another common secondary alcohol, is useful herein by virtue of its low water solubility and high melting point.

Many highly substituted alcohols are known to be water-insoluble and to have high melting points, and these are also useful herein. For example, although methanol is not useful herein because of its low melting point and high water solubility, 4-methyl benzyl alcohol is useful.

Alcohols and mixtures thereof with melting points below about 38° C are not useful herein. Only those alcohols which are solid or substantially solid at climatic temperatures commonly encountered are employed in the present compositions. Liquid (low melting) alcohols can be applied to fabrics to increase lubricity, but the solid (high melting) alcohols provide the desired benefits without tackiness.

Alcohols employed as the fabric crisping component herein are most preferably those which have melting points of from about 38° C to about 100° C, i.e., at temperatures within the range commonly encountered in a typical automatic clothes dryer. A melting point within this dryer operating range ensures that, in use, the alcohols are fluidized and are more efficiently transferred and deposited uniformly on the fabric surface. After the drying operation, the alcohol cools and solidifies to condition and soften the fabric. Alcohols melting above dryer temperatures are useful herein, but are not as efficiently transferred to fabrics. Such extremely high melting alcohol can be diluted with various adjunct materials, as described hereinafter, to lower their melting points to that encountered in a dryer.

In addition, the alcohols having melting points within the preferred range recited above are more easily transferred from the treated fabric to human skin through mechanical friction and body heat to provide desirable emolliency benefits. Sucn considerations are important when an alcohol such as cetyl alcohol, which is known to be a skin emollient, is employed in the articles of this invention.

A preferred class of alcohols useful herein includes the higher melting members of the so-called fatty alcohol class. Although once limited to alcohols obtained from natural fats and oils, the term "fatty alcohols" has come to means those alcohols which correspond to the alcohols obtainable from fats and oils, and all such alcohols can be made by synthetic processes. Fatty alcohols prepared by the mild oxidation of petroleum products are useful herein.

All fatty alcohols are substantially water-insoluble and the $C_{14}$ to $C_{18}$ fatty alcohols have the preferred melting points for use herein. Moreover, the fatty alcohols are preferred from the overall standpoint of availability, low cost, low color, and toxicological acceptability. A further consideration is that many fatty alcohols are known to impart emollient benefits to the skin. The saturated $C_{14}$ to $C_{18}$ fatty alcohols are most highly preferred for use herein, inasmuch as the corresponding unsaturated alcohols can oxidize at dryer temperatures and undesirably yellow fabrics.

Table I sets forth typical alcohols which are useful in the present articles, but is not intended to be limiting thereof.

TABLE I

| Alcohol | Melting Point °C |
|---|---|
| 1-Tricosanol | 74 |
| 1-Tetradecanol (myristyl alcohol) | 37.7 |
| 1-Pentadecanol | 44 |
| 1-Hexadecanol (cetyl alcohol) | 49.3 |
| 1-Heptadecanol | 54 |
| 1-Octadecanol (stearyl alcohol) | 59.5 |
| 1-Nonadecanol | 62 |
| 1-Eicosanol | 65 |
| 15-Methyl hexadecanol | 40.7 - 41.2 |
| 16-Methyl heptadecanol | 40.1 - 40.3 |
| 1-Heneicosanol | 69.5 |
| 1-Docosanol | 73.5 |
| 2-Octadecanol | 52 |
| 2-Nonadecanol | 52 |
| 2-Eicosanol | 60 |
| 2-Hexadecanol | 44 |
| 2-Heptadecanol | 44.5 |
| Tallowalkyl alcohol (mixture) | 46 - 47 |
| 1,1-Diphenyl hexadecanol | 47 - 48 |
| 2-Methyl-2-nonadecanol | 44 - 45 |
| 1,1-Diphenyl octadecanol | 58 |
| 4-Methylbenzyl alcohol | 59 - 60 |
| Phenyl 4-tolyl carbanol (4-methylbenzhydrol) | 58 (42, 53) |
| Isofenchyl alcohol | 62 |
| Propyl benzyl alchol | 49 |
| 3,3,5-Trimethylcyclohexanol | 55.8 |
| Diols | |
| 1,12-Octadecanediol | 66 - 67 |
| 1,10-Decanediol (decanmethylene glycol) | 72 - 75.5 |
| 3-(octadecyloxy)-1-2-propanediol (batyl alcohol) | 70 - 71 |
| α-Hexadecylglyceryl ether (chimyl) alcohol) | 64 |

While any of the foregoing alchols are useful in the compositions, processes and articles of manufacture of this invention, cetyl alchol is especially preferred from the standpoint of excellent crispness and desirable skin emolliency benefits. Stearyl alcohol is also preferred from the standpoint of commercial avalability. The fatty alcohol mixture derived from tallow carboxylic acids, and commonly referred to as tallowalkyl alcohol, is preferred from the standpoint of cost and availability. Mixtures of these alcohols are also useful herein.

Another type of material which can be classified as an alcohol and which can be employed in the instant articles encompasses various esters of polyhydric alcohols. Such "ester-alcohol" materials which have a melting point within the range recited herein and which are substantially water-insoluble can be employed herein when they contain at least one free hydroxyl group, i.e., when they can be classified chemically as alcohols. Such materials meet the requirements of the alcohols employed herein, and it is intended that the term "alcohol" encompasses such —OH containing ester-alcohol materials. This class of materials includes, for example, the mono- and di-esters of glycerol, such as those obtained from various oils and fats. The glycerol di-esters are particularly useful herein, inasmuch as they contain the requisite free hydroxyl group for bonding with fabric surfaces, are water-insoluble, and can be selected to have melting points within the required and preferred ranges herein. Finally, such di-esters of glycerol are available from commercial fats and waxes and are known to be toxicologically acceptable.

The alcoholic di-esters of glycerol preferred for use herein include both the 1,3-di-glycerides and the 1,2-di-glycerides. It is to be recognized that, inasmuch as glycerides containing one, or more, free hydroxyl groups are properly classifiable as alcohols, such materials can be employed as the whole of the fabric softener and conditioner herein. Alternatively, the glycerides can be mixed with waxes, triglycerides, and the like, to provide a spectrum of tactile stimuli on the fabrics. In particular, di-glycerides containing two $C_8$–$C_{20}$, preferably $C_{10}$–$C_{18}$, alkyl groups in the molecule provide a soft handle to fabrics which is reminiscent of the effect achieved with the di-long chain alkylammonium fabric softeners in common use. The di-long chain alkyl groups in such di-ester alcohols provide a soft, lubricious feel when these materials are employed in the articles herein.

Mono- and di-ether alcohols, especially the $C_{10}$–$C_{18}$ di-ether alcohols having at least one free -OH group, also fall within the definition of alcohols useful herein.

The ester-alcohols employed herein can be synthetically produced in well-known fashion by esterifying a poly-ol with an amount of a carboxylic acid or anhydride such that one, or more, of the -OH groups remain unesterified. For example, reacting one mole of glycerol (3—OH groups) with 2 moles of lauric acid provides mixtures of 1,2- and 1,3-dilauryl esters of glycerol. Such mixtures can be separated if desired, but the mixtures, themselves, are suitable for use herein. In like manner there can be produced 1,2- and 1,3-di-myristic, di-palmitic and di-stearic acid esters of glycerol. Mixed tallow fatty acids can also be employed to prepare mixed esters and are economically attractive.

The ether-alcohols useful herein can be prepared by the classic Williamson ether synthesis. As with the ester-alcohols, the reaction conditions are chosen such that at least one free, unetherified -OH group remains in the molecule.

The ester-alcohols are prefereed for use herein over the ether-alcohols due to their availability and known toxicological acceptability.

Non-limiting examples of ester-alcohols useful herein include: glycerol-1,2-dilaurate, glycerol-1,3-dilaurate, glycerol-1,2-myristate, glycerol-1,3-dimyristate, glycerol-1,2-dipalmitate, glycerol-1,3-dipalmitate, glycerol-1,2-distearate and glycerol-1,3--distearate. Mixed glycerides available from mixed tallowalkyl fatty acids, i.e., 1,2-ditallowalkyl glycerol and 1,3-ditallowalkyl glycerol, are economically attractive for use herein. The foregoing ester-alcohols are preferred for use herein due to their ready availability from natural fats and oils.

Other ester-alcohols useful herein include glycerol-1-stearate-2-palmitate, butane tetra-ol-1,2,3-tristearate, sorbitol tristearate and the like.

Ether-alcohols useful herein include glycerol-1,2-dilauryl ether, glycerol-1,3-distearyl ether, and butane tetra-ol-1,2,3-trioctanyl ether.

The substantially water-insoluble carboxylic acids and the substantially water-insoluble salts thereof having melting points as set forth above are also useful conditioners in the articles of this invention.

When selecting a carboxylic acid or carboxylate salt for use herein, the same considerations apply as to operable and preferred melting point ranges, water solubility, lack of color, non-hygroscopicity, etc., as in the case of the fatty alcohols. As with the alcohols, all manner of water-insoluble aliphatic, aromatic, olefinic, aralkyl, heterocyclic, etc., carboxyic acids and salts are useful herein.

Fatty acids, synthetic or natural, especially the saturated fatty acids, are preferred herein because of their availability and price. Fatty acids are also recognized as skin emollients. Saturated fatty acids are preferred herein since they do not decompose at dryer operating temperatures.

Water-insoluble carboxylate salts, especially the salts of the $C_8$–$C_{20}$ fatty acids, are also useful herein. Such salts can be prepared by neutralizing the free acids with a metallo base, e.g., $Mg(OH)_2$, $Ca(OH)_2$, and the like, in well-known fashion. The cation of the base then becomes the cation of the carboxylate salts. Of course, it is preferred to use salts of non-toxic cations. Colorless carboxylate salts are preferred, and lack of color will dictate the selection of cation for use in the case of the most preferred carboxylates. The $Ca^{++}$ and $Mg^{++}$ carboxylate salts are preferred herein by virtue of low cost, ready availability, and the foregoing considerations.

Table II sets forth a selection of non-limiting examples of carboxylic acids which can be employed herein. It is to be understood that the $Ca^{++}$ and $Mg^{++}$ salts of each of these listed acids are also useful for this purpose.

TABLE II

| | Mp ° C |
|---|---|
| Dodecanoic acid | 44.2 |
| Tridecanoic acid | 41.5 |
| Tetradecanoic acid | 53.9 |
| Pentadecanoic acid | 52.3 |
| Hexadecanoic acid | 63.1 |
| Heptadecanoic acid | 61.3 |
| Octadecanoic acid | 69.6 |
| Nonadecanoic acid | 68.6 |
| Eicosanic acid | 75.3 |
| Heneicosanoic acid | 74.3 |
| 2-Propyloctadecanoic acid | 46 |
| 5-Methyloctadecanoic acid | 48 |
| 6-Methyloctadecanoic acid | 45 |
| 12-Methyltridecanoic acid | 53 |
| 15-Methyloctadecanoic acid | 43.5 |
| 2-Butyloctadecanoic acid | 50 |
| 2-Hexyloctadenoic acid | 53.5 |
| 2-Nonyloctadecanoic acid | 47 |
| 2-Hexadecenoic acid | 57.5 |
| Trans-6-Octadecenoic acid | 54 |
| Trans-9-Octadecenoic acid | 46.5 |
| Phenylacetic acid | 76.5 |
| γ-Phenyl butyric acid | 52 |

OPTIONAL COMPONENTS

Various optional additives can also be used in the articles herein. Although not essential to the invention, certain fabric treating additives are particularly desirable and useful, e.g., brightening agents, shrinkage controllers, spotting agents, and the like.

While not essential, liquids which serve as a diluent for the softening agent can be employed. Such liquids can be used to more evenly impregnate absorbent carrier substrates with the softening agent. When a liquid diluent is so used, it should preferably be inert or stable with the fabric softener and with the particulate material herein. Moreover, the liquid carrier should be substantially evaporated at room temperatures, and the residue (i.e., the softening agent) should then be sufficiently hardened so as not to run or drip off the substrate, or cause the substrate to stick together when folded. Isopropyl alcohol or isopropyl alcohol/water mixtures are the preferred liquid carriers for these purposes; methanol, ethanol, acetone, ethylene glycol or propylene glycol can also be used.

Other additives can include various finishing aids, fumigants, lubricants, fungicides, and sizing agents. Specific examples of useful additives can be found in any current Year Book of the American Association of Textile Chemists and Colorists.

The amounts of such additives (e.g., fumigants and brighteners) used in the articles herein are generally small, being in the range of from 0.001% to about 10% by weight of the article.

In preparing the preferred articles herein containing both the particulate material and the softener it is often advantageous to include a surfactant to help provide easy, yet controlled and uniform release of the softener from the carrier. Uniform release of the softener helps prevent staining of synthetic fabrics.

Various surfactants are useful herein. For example, the nonionics, especially the well-known ethoxylated fatty alchols having a hydrophilic-lipophilic balance of from about 2 to about 15 are useful herein. Anionic surfactants, especially tallow alkyl sulfate, can also be employed.

The selection of optimal surfactants will vary somewhat, depending on the type of softener chosen for use in the articles. For example, anionic surfactants ae preferably not used in combination with cationic softeners, inasmuch as cation-anion reactions occur. Nonionic surfactants are employed with cationic softeners. When nonionic softeners (i.e., the alcohol, glyceride and sorbitan softeners) are used in the articles, they can be combined with either anionic or nonionic surfactants.

It is to be understood that, while the selection of surfactants is not critical to the operation of the articles herein, surfactant-softener mixtures can be employed to modify their performance properties. The articles herein can contain from about 0.001% to about 10% by weight of article of a surfactant.

ARTICLE MANUFACTURE

The articles herein comprise the particulate material, preferably in combination with a softener, and carrier substrate. When the carrier is to be a porous pouch, the particulate material, and optional ingredients and softener, are simply admixed thoroughly and placed in the pouch, which is then sewn, or otherwise permanently sealed. The pouch is fashioned from a material whose average pore diameter is 10% to 15% larger than the particulate material contained therein. The tumbling action of the dryer causes the material to sift through the pores evenly onto all fabric surfaces.

Preferred articles herein are provided in sheet form, for the reasons disclosed above. A carrier sheet is releasably coated with sufficient particulate material to treat one average load (5–8 lbs.) of fabrics. The coating process involves, for example, coating the sheet with an inert, unobjectionable, somewhat tacky material such as any of the marine agars and thereafter impressing the desired amount of particulate material into the coating. Heat and the tumbling action of the dryer releases the particulate material onto fabric surfaces.

Highly preferred sheet articles herein are those comprising both the particulate material and a softener, most preferably wherein the softener is impregnated into the absorbent sheet substrate. In such articles, the softener provides both a fabric softening action and a means whereby the particulate material can be releasably affixed to the sheet.

Impregnation with the softener can be done in any convenient manner, and many methods are known in the art. For example, the softener, in liquid form, can be sprayed onto a substrate or can be added to a woodpulp slurry from which the substrate is manufactured. Sufficient softener remains on the surface to conveniently affix the particles to the substrate.

Impregnating, rather than merely coating, the substrate with a softener provides optimal softening without fabric staining. The term "coating" connotes the adjoining of one substance to the external surface of another; "impregnating" is intended to mean the permeation of the entire substrate structure, internaly as well as externally. One factor affecting a given substrate's absorbent capacity is its free space. Accordingly, when a softening agent is applied to an absorbent substrate, it penetrates into the free space; hence, the substrate is deemed impregnated. The free space in a substrate of low absorbency, such as a one-ply kraft or bond paper, is very limited; such as substrate is, therefore, termed "dense." Thus, while a small portion of the softening agent penetrates into the limited free space available in a dense substrate, a rather substantial balance of the softener does not penetrate and remains on the surface of the substrate so that it is deemed a coating. The difference between coating and impregnating is believed to explain why the softener-impregnated sheet substrates of the invention herein eliminate or substantially reduce the staining of fabrics observed when a softener-coated dense substrate is utilized.

in a preferred method of making the softener plus particulate sheeted articles herein, the softener (alone or with the optional additives) is applied to absorbent paper or non-woven cloth by a method generally known as padding. The softening agent is preferably applied in liquid form to the substrate. For example, sorbitan ester softeners which are normally solid at room temperature should first be melted and/or solvent treated with one of the liquid carriers mentioned hereinbefore. Methods of melting the softener and/or for treating the softener with a solvent are known and can easily be done to provide a satisfactory softener-treated substrate.

In another preferred method, the softener is placed in a pan or trough which can be heated to maintain the softener in liquid form. To the liquid softener are then added any desired additives. A roll of absorbent paper (or cloth) is then set up on an apparatus so that it can unroll freely. As the paper unrolls, it travels downwardly and, submersed, passes through the pan or trough containing the liquid softener at a slow enough speed to allow sufficient impregnation. The absorbent paper than travels upwardly and through a pair of rollers which remove excess bath liquid and provide the absorbent paper with about 1 to about 12 grams of the softening agent per 100 in.$^2$ to 150 in.$^2$ of substrate sheet. The impregnated paper is then coated with the particulate material (generally 0.1 g. to 5 g. per 100 in.$^2$ to 150 in.$^2$) and cooled to room temperature, after which it can be folded, cut or perforated at uniform lengths, and subsequently packaged and/or used.

In another method, the softening agent, in liquid form, is sprayed onto absorbent paper as it unrolls and the excess softener is then squeezed off by the use of squeeze rollers or by a doctor-knife. Other variations include the use of metal "nip" rollers on the leading or entering surfaces of the sheets onto which the softening agent is sprayed; this variation allows the absorbent paper to be treated, usually on one side only, just prior to passing between the rollers whereby excess softener is squeezed off. This variation can optionally involve the use of metal rollers which can be heated to maintain the softener in the liquid phase. Optionally, the particulate material can be impressed onto the sheet by means of such rollers. A further method involves separately treating a desired number of the individual plies of a multi-ply paper and subsequently adhesively joining the plies with a known adhesive-joinder compound; this provides an article which can be untreated on one of its outer sides, yet contains several other plies, each treated on both sides.

In applying the softening agent to the absorbent substrate, the amount of softener impregnated into the absorbent substrate is conveniently in the ratio range of 10:1 to 1:1 by weight softener:dry, untreated substrate. Preferably, the amount of the softening agent impregnated is from about 4:1 to about 1.2:1, particularly 1.25:1, by weight of the dry, untreated substrate.

Following application of the liquified softener and the particulate material, the articles are held at room temperature until the softener solidifies. The resulting dry articles, prepared at the softener: substrate ratios set forth above, remain flexible; the sheet articles are suitable for packaging in rolls. The sheet articles can optionally be slitted or punched to provide a non-blocking aspect at any convenient time during the manufacturing process.

The most highly preferred articles herein are those where the particulate material and softener are releasably affixed to a sheet substrate of the type disclosed hereinabove having an absorbent capacity of from about 5.5 to about 12. A highly preferred substrate for such an article has from about 40% to about 90% free space based on the overall volume of the substrate. The most highly preferred substrate for the articles comprises a water-laid or air-laid nonwoven cloth consisting essentially of lubricated cellulosic fibers, said fibers having a length of about 3/16 inches to about 2 inches and a denier from about 1.5 to about 5, said fibers being at least partially oriented haphazardly, and adhesively bonded together with a binder-resin. Such water-laid or air-laid non-woven cloths can easily be prepared having the preferred absorbent capacities and free space set forth above.

The most highly preferred articles herein are those wherein the flexible sheet substrate is provided with openings sufficient in size and number to reduce restriction by said article of the flow of air through the automatic dryer. Articles wherein the openings comprise a plurality of rectilinear slits extending along one dimension of the substrate, especially those wherein the slits extend to within 1 inch from at least one edge of said dimension of the substrate, articles wherein the slits comprise a plurality of curvilinear slits in a continuous pattern of U-shaped or C-shaped slits, and articles wherein the openings comprise circular holes, are highly preferred herein.

It is most convenient to provide an article in the form of a non-blocking sheet substrate having the physical parameters noted hereinabove, said substrate having an area of from about 50 in.$^2$ to about 200 in.$^2$, comprising from about 0.1 grams to about 10 grams of the particulate material releasably affixed thereto and from about 1.5 grams to about 7.5 grams of the softener releasably impregnated in said substrate. Such articles can be provided with, as an additional component, any of the fabric treating additives of the type disclosed hereinabove. The articles are provided with openings such as the holes or slits described hereinabove, said openings comprising from about 0.5% to about 75%, preferably 5% to about 40%, of the area of the article, said opening being so disposed as to provide a non-blocking effect.

USAGE

In the process aspect of this invention the articles are used to condition and soften fabrics in an automatic dryer. The effective, i.e., conditioning and softening, amount of the active ingredients used in the articles of this invention will depend somewhat on the type of fabric being treated. For most purposes, the particulate materials are applied to fabrics at a level of about 0.01 gram to 12 grams, preferably 1 gram to 7 grams, and the softener is applied at a level of 0.01 gram to about 12.0 grams, preferably 2 g. to about 7 g., all based on a fabric load of 5 lbs. (ca. 180 sq. ft.) of fabric (dry fabric weight basis). Higher usage rates can be employed, if desired, but with little noticeable advantage.

The process herein is carried out in the following manner. Damp fabrics, usually containing from about 1 to about 1.5 times their weight of water, are placed in the drum of an automatic clothes dryer. In practice, such damp fabrics are commonly obtained by laundering, rinsing and spin-drying the fabrics in a standard washing machine. An article prepared in the manner of this invention is simply added thereto. The dryer is then operated in standard fashion to dry the fabrics, usually at a temperature from about 50° C to about 80° C for a period from about 10 minutes to about 60 minutes, depending on the fabric load and type. The heat and tumbling action of the revolving dryer drum evenly distributes the active ingredients from the article over all fabric surfaces, and dries the fabrics. On removal from the dryer, the dried fabrics are conditioned and softened.

The following examples illustrate the articles of this invention but are not intended to be limiting thereof.

EXAMPLE I

A dryer-added fabric softening article is prepared by sprinkling 5.0 grams of a sorbitan ester mixture comprising about 50% (wt.) of 1,4-sorbitan monostearate uniformly over the surface of an air-laid non-woven cloth comprising 70% regenerated cellulose (American Viscose Corporation) and 30% hydrophobic binder-resin (Rhoplex HA-8 on one side of the cloth, and Rhoplex HA-16 on the other side; Rohm & Has, Inc.). The cloth has a thickness of 4 to 5 mils, a basis weight of about 24 grams per square yard and an absorbent capacity of 6. A one-foot length of the cloth, 8⅓ inches wide, weighs about 1.78 grams. The fibers in the cloth are ca. ¼ inch in length, 1.5 denier, and are oriented substantially haphazardly. The fibers in the cloth are lubricated with sodium oleate. The substrate cloth is 10 inch × 11 inch.

The sorbitan ester-covered cloth is transferred to a heated plate, whereupon the ester melts and impregnates the inter-fiber free space in the cloth substrate. DRY-FLO starch, 1.5 grams, avg. particle diameter 10 μm, is sprinkled uniformly over the surface of the ester-covered cloth and pressed in place with a wide-blade spatula. The article is removed from the hot plate and allowed to cool to room temperature, whereby the ester solidifies. The cloth retains its flexibility. The starch particles are releasably affixed thereto.

Following solidification of the sorbitan ester; the cloth is slitted with a knife. (Conveniently, the cloth is provided with 5 to 9 rectilinear slits extending along one dimension of the substrate, said slits being in a substantially parallel relationship and extending to within about one inch from at least one edge of said dimension of the substrate.) The width of an individual slit is ca. 0.2 inches.

An article prepared in the foregoing manner is placed in an automatic clothes dryer together with 5 lbs. of freshly washed, damp (ca. 5.5 lbs. water) mixed cotton, polyester, and polyester/cotton blend clothes. The automatic dryer is operated at an average temperature of 60° C for a period of 45 minutes. During the course of the drying operation the clothes and softener article are constantly tumbled together by the rotation of the dryer drum. After the drying cycle, the clothes are removed from the dryer into a room having a relative humidity of 50. The clothes are found to exhibit excellent softness and anti-static properties with no substantial staining. The clothes are provided with an anti-wrinkling finish and require less force to iron. Moreover, the clothes are provided with an anti-static finish. (The extent of static control is measured in a Faraday cage; the anti-wrinkling effect is measured photoelectrically; ease-of-ironing is measured by means of a commercial hand iron equipped with force measuring sensors, all as described in the copending application of Edwards and Diehl, entitled FABRIC SOFTENING COMPOSITIONS WITH IMPROVED CONDITIONING PROPERTIES, Ser. No. 357,130, filed May 4, 1973, incorporated herein by reference.)

Equivalent results are secured when, in the foregoing article, the 1,4-sorbitan monostearate is replaced by an equivalent amount of 1,5-sorbitan monostearate; a 1:1 (wt.) mixture of 1,4-sorbitan monostearate and 1,4-sorbitan distearate; a 1:1 (wt.) mixture of 1,5-sorbitan monostearate and 1,5-sorbitan distearate; a 1:1 (wt.) mixture of 1,4-sorbitan monostearate and 1,5-sorbitan monostearate; a 1:1 (wt.) mixture of 1,4-sorbitan monostearate and 1,5-sorbitan distearate; a 1:1 (wt.) mixture of 1,4-sorbitan distearate and 1,5-sorbitan monostearate; and a 1:1 (wt.) mixture of 1,4-sorbitan distearate and 1,5-sorbitan distearate, respectively.

EXAMPLE II

A dryer-added fabric softening article is prepared in the following manner. A 70:30 (wt.) mixture of ditallowalkyldimethylammonium methylsulfate and SPAN 60 (ICI's commercial mixture of sorbitan "stearate" comprising a total of about 90% by weight total sorbitan and isosorbide fatty esters, and approximately equal amounts of free fatty acid, free sorbitol, free sorbitan, minor proportions of isosorbide, about 31% by weight of the mixture comprising sorbitan monoesters) is placed in a trough and heated until melted.

A 10-inch wide roll of paper substrate, said substrate being a compressible, laminated and calendered absorbent paper structure comprising two extensible paper sheets, each sheet (or ply) having a basis weight of about 16 lbs. per 3,000 square feet and a MD value of about 660, a CD value of about 380 and 20% drycrepe is used as the carrier. Each sheet of the paper substrate is embossed with identical raised patterns consisting of about 70 inwardly directed discrete protuberances per square inch, raised about 0.02 inches above the surface of the paper sheets. The protuberances constitute about 45% of the surface of each sheet and are mated and adhesively joined with polyvinyl alcohol resin. The paper structure exhibits a compressive modulus of about 340 together with HOM MD/CD values of about 36/31 and has an absorbent capacity of about 7. (This paper is a particularly preferred paper substrate herein and weighs about 3.7 grams per 11 inch × 12 inch sheet.)

The paper sheet substrate is mounted on a roll and is unrolled in the trough. The paper travels at a rate of 5–6 feet per minute and is then directed upwardly and through the pair of hard, rubber rollers mounted so that their surfaces just touch. The turning rollers squeeze off excess softener liquid and impregnate the paper with the softener at a softener:paper impregnation ratio of ca. 2.7:1 by weight of the dry, untreated paper.

DRY-FLO starch (avg. particle diameter 10 μm) is blown onto the warm softener-impregnated substrate at an angle perpendicular to the plane of the substrate using air pressure of ca. 30 psia. The starch is applied at a starch:substrate weight ratio of ca. 2:1.

The impinging stream of air/starch affixes the starch releasably to the surface of the softener-impregnated paper and concurrently cools and solidifies the softener. The resulting paper article is substantially solid, yet flexible, is stable to decomposition, not "runny" or dripping, and which, although waxy to the touch, does not stick together when folded.

An 11 in. × 12 in. paper-impregnated article prepared in the foregoing manner is punched with 9 evenly-spaced 0.5 in. diameter holes. The article is placed in an automatic clothes dryer together with 5 lbs. of mixed clothes which are dampened with an equal amount of water. The dryer is operated at an average temperature of 56° C for a period of 40 minutes, with tumbling. At the end of the drying cycle, the dry clothing has an improved appearance and handle, is easy to iron. No substantial staining of the fabrics is observed. The dryer operates without any vent blockage.

In the foregoing article the SPAN 60 is replaced by an equivalent amount of SPAN 40 (the corresponding complex mixture of sorbitan palmitates marketed by ICI) and equivalent results are secured. An article according to Example II is prepared using an equivalent amount of mixed sorbitan stearates and palmitates prepared by mixing the SPAN 60 and SPAN 40 at weight rations of SPAN 60:SPAN 40 of 10:1; 5:1; 2:1; 1:2; 1:5; and 1:10, respectively, and equivalent results are secured.

An article according to Example II is prepared using an equivalent amount of dicoconutalkyldimethylammonium methylsulfate, ditallowalkyldimethylammonium chloride and ditallowalkyldimethylammonium bromide, respectively, to replace the ditallowalkyldimethylammonium methylsulfate, and equivalent fabric conditioning benefits are secured.

EXAMPLE III

A non-staining dryer-added softener article is as follows. DURTAN 60 (Durkee Foods; comprising greater than 30% by weight stearic and palmitic acid esters of sorbitan, free stearic acid, free palmitic acid, free sorbitol, free sorbitan and minor amounts of isosorbide and esters thereof; 10 grams) is added to 25 mls. of isopropyl alcohol. Ditallowalkylimethylammonium methylsulfate (0.5 gram), 0.1 g. of mixed coconut alcohol ethoxylates habving an average degree of ethoxylation of 6, and 0.01 g. of perfume are added to the mixture. DRY-FLO starch (avg. diameter 10 μm; 1.5 grams) is added and the mixture is stirred and warmed to about 35° C to provide a free flowing slurry of the fabric treating components.

The substrate used is an 11 in. × 12 in. water-laid, non-woven cloth commercially available from the C. H. Dexter Co., Inc., comprising fibers of regenerated cellulose, about ⅜ in. in length, about 1.5 denier, and lubricated with a standard textile lubricant. The fibers comprise about 70% of the non-woven cloth by weight and are oriented substantially haphazardly; a binder-resin (HA-8) comprises about 30% by weight of the cloth. The cloth is about 4 mils thick, has a basis weight of about 24 grams per square yard and an absorbent capacity of 5.7. One foot length of the cloth, 8⅓ inches wide, weights about 1.66 grams.

The substrate cloth is placed in a shallow trough and is sprayed uniformly with the above-described isopropyl alcohol mixture. Four separate sprayings are used, i.e., each spraying uses ca. ¼ of the above-described mixture. The isopropyl alcohol is allowed to evaporate from the substrate after each spraying. After the final spraying, the article is allowed to dry at room temperature, overnight. The final article is substantially free from isopropyl alcohol, is flexible, and contains the fabric treating components uniformly and releasably impregnated throughout the substrate free space and on its surface.

The article prepared in the foregoing manner is placed in an automatic dryer together with 5.5 lbs. of damp (3 lbs. water) clothes and the dryer is operated with tumbling at an average temperature of 65° C for a period of 35 minutes. On removal from the dryer, the clothes are found to be provided with a uniform soft and anti-static finish, are easy to iron, and are substantially stain-free.

The article of Example III is modified by replacing the DRY-FLO starch with an equivalent amount of PF-11 glass beads (as described above), glass microballoons (avg. diameter 30 μm), polystyrene spheroid beads (avg. diameter 14–16 μm), and poly(styrenedivinylbenzene) spheres (avg. diameter 6 μm), respectively, and equivalent fabric conditioning results are secured.

EXAMPLE IV

Cornstarch (ungelatinized; average particle diameter 20 μm; anisotropy ca. 1.1) 200 grams, is suspended in anhydrous diethyl ether. Stearoyl chloride, 20 g., is added to the suspension of cornstarch, with agitation. The mixture is refluxed for 1 hour, after which the starch particles are recovered by filtration. The starch particles, which are rendered hydrophobic by virtue of their esterification with the stearoyl chloride, are placed in vacuo to remove remaining traces of ether.

A dryer-added fabric conditioning article is prepared in the following manner. A sheet of non-woven rayon cloth, 10 inches square, is uniformly impregnated and coated with a syrupy aqueous solution of food-grade gelatin at a weight ratio of cloth:gelatin of 1:1. Following this treatment, and while the gelatin is still tacky, 1.5 grams of the stearylated cornstarch prepared in the foregoing manner is uniformly blown over both sides of the cloth. Following this, the cloth is blown dry using a stream of 30° C dry air. The resulting article is flexible and retains the starch granules releasably on its surface.

An article prepared in the foregoing manner is placed together with 5 lbs. of damp (spun dry) fabrics in an automatic clothes dryer. The dryer is operated at an average temperature of 57° C over a period of 40 minutes. After this time, the fabrics are removed from the dryer and are found to be provided with an anti-wrinkling finish which is substantially easier to iron than corresponding untreated fabrics.

In the article of Example IV, the stearylated cornstarch is replaced by an equivalent amount of stearylated rice starch, and equivalent results are secured.

In the article of Example IV, the surface-modified (stearylated) starches are replaced by an equivalent amount of cornstarch, wheat starch and rice starch, said starches being ungelatinized and characterized by a swelling power of less than about 15 at a temperature of 65° C, substantial water-insolubility, and a particle size within the range of about 15 μm to about 25 μm, and equivalent fabric conditioning results are secured.

What is claimed is:

1. An article adapted for concurrently softening and conditioning fabrics in an automatic clothes dryer wherein a softener and a water-insoluble particulate material are transferred to fabrics thereby giving the fabrics softening, anti-wrinkling and ease-of-ironing benefits, comprising:
   a. a softening amount of a fabric softener characterized by a melting point above about 38° C;
   b. a fabric conditioning amount of a substantially water-insoluble particulate material characterized by:
      i. an average particle size of from about 1.0 μm to about 50 μm;
      ii. a shape having an anisotropy of from about 5:1 to about 1:1;
      iii. a hardness of less than about 5.5 on the Mohs scale;
      iv. a melting temperature above about 150° C; and
      v. substantial freedom from exchangeable calcium and magnesium ions; said softener and said particulate material being in releasable combination with;
   c. a water-insoluble dispensing means.

2. An article according to claim 1 wherein the fabric softener is a quaternary ammonium salt having two $C_{10}$–$C_{20}$ fatty alkyl substituents.

3. An article according to claim 2 wherein the quaternary ammonium salt is selected from ditallowalkyldimethylammonium methylsulfate, dicoconutalkyldimethylammonium methylsulfate, and mixtures thereof.

4. An article according to claim 1 wherein the fabric softener is selected from $C_{10}$–$C_{22}$ alkyl mono- and di-sorbitan esters, and mixtures thereof.

5. An article according to claim 4 wherein the sorbitan esters are selected from the group consisting of sorbitan monolaurate, sorbitan monomyristate, sorbitan monopalmitate, sorbitan monostearate, sorbitan dilaurate, sorbitan dimyristate, sorbitan dipalmitate, sorbitan distearate, and mixtures thereof, and mixed coconutalkyl sorbitan mono- and di-esters and mixed tallowalkyl sorbitan mono- and di-esters.

6. An article according to claim 1 wherein the fabric softener is a member selected from the group consisting of quaternary ammonium salts containing two $C_{10}$–$C_{20}$ alkyl substituents, $C_{10}$–$C_{22}$ alkyl sorbitan mono- and di-esters, and mixtures thereof, and wherein the particulate material is selected from substantially water-insoluble surface-treated starches bearing hydrophobic moieties or starches having a swelling power of less than about 15 at a temperature of 65° C.

7. An article according to claim 1 wherein the dispensing means is in a sheet conformation.

8. An article according to claim 7 wherein the dispensing means is selected from water-insoluble paper, woven cloth or non-woven cloth sheets.

9. An article according to claim 8 wherein the sheets are provided with slits or holes.

10. An article according to claim 9 wherein the water-insoluble particulate material is a surface-treated starch bearing hydrophobic moieties or a starch having a swelling power of less than about 15 at a temperature of 65° C, and wherein the fabric softener is selected from $C_{10}$–$C_{22}$ mono- and di-alkyl sorbitan esters, and mixtures thereof.

11. An article according to claim 9 wherein the water-insoluble particulate material is a surface-treated starch bearing hydrophobic moieties or a starch having a swelling power of less than about 15 at a temperature of 65° C, and wherein the fabric softener is a quaternary ammonium salt selected from ditallowalkyldimethylammonium methylsulfate, dicoconutalkyldimethylammonium methylsulfate, and mixtures thereof.

12. An article according to claim 9 wherein the water-soluble particulate material is a surface-treated starch bearing hydrophobic moieties or a starch having a swelling power of less than about 15 at a temperature of 65° C, and wherein the fabric softener comprises a mixture of quaternary ammonium salts and sorbitan esters, said quaternary ammonium salts being characterized by two $C_{10}$–$C_{20}$ alkyl substituents, or mixtures thereof, said ammonium salts being in the methylsulfate form, and wherein the sorbitan esters are selected from the $C_{10}$–$C_{22}$ alkyl sorbitan mono- and di-esters, and mixtures thereof.

13. An article according to claim 1 wherein the water-insoluble particulate material is selected from the group consisting of synthetic polymeric beads, glass beads, coated glass beads, hollow glass beads and ceramic beads.

* * * * *